US005370503A

United States Patent [19]

Terauchi

[11] Patent Number: 5,370,503

[45] Date of Patent: Dec. 6, 1994

[54] SWASH PLATE TYPE COMPRESSOR WITH VARIABLE DISPLACEMENT MECHANISM

[75] Inventor: Kiyoshi Terauchi, Isesaki, Japan

[73] Assignee: Sanden Corporation, Isesaki, Japan

[21] Appl. No.: 59,126

[22] Filed: May 10, 1993

[30] Foreign Application Priority Data

May 8, 1992 [JP] Japan ..... 4-115907

[51] Int. Cl.[5] ..... F09B 1/26

[52] U.S. Cl. ..... 417/222.2; 417/270; 74/60

[58] Field of Search ..... 417/222.2, 222.1, 270; 74/60

[56] References Cited

U.S. PATENT DOCUMENTS

| | | | |
|---|---|---|---|
| 4,425,837 | 1/1984 | Livesay | 92/71 |
| 4,553,905 | 11/1985 | Swain et al. | 417/222 |
| 4,664,604 | 5/1987 | Terauchi | 417/222 |
| 4,674,957 | 6/1987 | Ohta et al. | 417/222 |
| 4,782,712 | 11/1988 | Takahashi et al. | 74/60 |
| 4,836,090 | 6/1989 | Smith | 417/222.2 |
| 4,865,523 | 9/1989 | Kikuchi et al. | 417/222 |
| 4,872,815 | 10/1989 | Takai | 417/222 |
| 4,884,952 | 12/1989 | Kanamaru et al. | 417/222.2 |
| 4,886,423 | 12/1989 | Iwanami et al. | 417/222.2 |
| 4,963,074 | 10/1990 | Sawuki et al. | 417/222 |
| 5,022,826 | 6/1991 | Matsuda et al. | 417/222.1 |
| 5,032,060 | 7/1991 | Kobayashi et al. | 417/222.1 |
| 5,055,004 | 10/1991 | Ebbing et al. | 417/222.2 |
| 5,259,736 | 11/1993 | Terauchi | 417/222.1 |
| 5,282,725 | 2/1994 | Shimizu | 417/222.1 |

FOREIGN PATENT DOCUMENTS 1436390 5/1976 United Kingdom .

*Primary Examiner*—Richard A. Bertsch
*Assistant Examiner*—Peter Korytnyk
*Attorney, Agent, or Firm*—Baker & Botts

[57] ABSTRACT

A swash plate type compressor with a variable displacement mechanism includes a compressor housing having a cylinder block provided with a plurality of cylinders and a crank chamber. A piston is slidably fitted within each of the cylinders and is reciprocated by a drive mechanism. The drive mechanism includes a drive shaft rotatably supported by the compressor housing, a pair of rotor plates fixed on the drive shaft and a swash plate having a surface with an adjustable tilt angle. The rotor plates are arranged on opposite sides of the swash plate. A plurality of slide contact coupling mechanisms extend between the swash plate and the rotor plate. The slide contact coupling mechanisms include two arms extending from opposite sides of the swash plate and a projection extending from one of the two rotor plates.

18 Claims, 4 Drawing Sheets

SWASH PLATE TYPE COMPRESSOR WITH VARIABLE DISPLACEMENT MECHANISM

BACKGROUND OF THE INVENTION

1. Field of the Invention

The invention relates to a swash plate type compressor with a variable displacement which is particularly suitable as a refrigerant compressor for an automotive air-conditioning apparatus.

2. Description of the Prior Art

A swash plate refrigerant compressor with a variable displacement mechanism suitable for use in an automotive air condition system is disclosed in U.S. Pat. No. 4,963,074. As disclosed therein, the swash plate is supported on a rotatable shaft of the compressor. The swash plate is fixedly supported on the rotatable shaft through a single hinge coupling mechanism. More particularly, the hinge coupling mechanism of the '074 patent includes a projection extending from the swash plate and an axial slit formed in the projection. A planar plate portion, which is mounted on the drive shaft, aligns with the slit. A pin extends from the projection portion of the swash plate and penetrates the planar plate portion.

One of the disadvantages of the of the '074 compressor is that a large axial force acts on the single hinge coupling mechanism, thereby causing excessive wear between the outer peripheral surface of the pin and slit. As a result of this wear and deterioration of the hinge coupling mechanism, capacity control of the compressor is adversely affected and adjustment of the piston stroke becomes less accurately controlled.

Another prior art swash plate compressor is shown in FIGS. 1 and 2. There, first arm potion 27*d* of swash plate 27 and second arm portion 27*c* are symmetrically disposed with respect to the center of swash plate 27. First arm portion 27*d* is coupled to projection 30*a* of first rotor plate 30 through pin 37*b*. Second arm portion 27*c* is coupled with projection 29*a* through pin 37*a*. Pins 37*a*, 37*b* are fixed in position by snap rings. While two hinge coupling mechanisms support swash plate 27, as seen in FIG. 2, the hinge coupling mechanism requires several parts, e.g., arms 27*c*, 27*d*, pins 37*a*, 37*b*, snap rings 48, etc., to effect the hinged coupling. Consequently, the intricacy, and potentially the cost, of the compressor is increased by the number of parts comprising the hinge coupling mechanism.

SUMMARY OF THE INVENTION

It is an object of the preferred embodiments to provide a swash plate type compressor having a hinge coupling mechanism which is durable in operation but requires few parts.

A swash plate type compressor according to the preferred embodiment comprises an annular compressor housing defining a crank chamber. On both sides of crank chamber are cylinder blocks, and outside of cylinder blocks are valve plates and end plates. A drive shaft penetrates one of the end plates and is rotatably supported within the compressor housing. A swash plate is disposed on the drive shaft within the crank chamber. A plurality of cylinders are formed in the cylinder blocks. Two-sided pistons are slidably disposed in each cylinder and are operatively coupled to the swash plate through bearings.

A bore is formed in one of the cylinder blocks. An actuator is slidably disposed with the bore. The distal end of the drive shaft penetrates a portion of the actuator. A control chamber is formed centrally in one of the end plates behind the actuator. A first communication path extends from the discharge chamber to the control chamber. A second communication path extends from the control chamber to the suction chamber. A valve control mechanism is disposed in the second communication path to selectively open and close the second communication path.

A hinge coupling mechanism allows the swash plate to assume various angles with respect to the longitudinal axis of the drive shaft. More particularly, the hinge coupling mechanism comprises a first rotor plate fixedly disposed on the drive shaft for rotation therewith and in thrust contact with one of the cylinder blocks. The first rotor plate has a frustoconical surface and a projection member extending from the frustoconical surface. Additionally, the hinge coupling mechanism includes a second rotor plate axially slidably disposed on drive shaft. The second rotor plate also has a frustoconical surface.

The swash plate is disposed on the drive shaft between the first and second rotor plates. The swash plate has a first arm portion corresponding to the projection on the frustoconical surface on the first rotor plate. The projection is positioned between the first arm portion. The end surface of the first arm portion slidably contacts the frustoconical surface of the first rotor plate.

Similarly, the swash plate includes another arm on the opposite side thereof and radially opposed to the first arm portion. The second arm portion includes an end surface which slidably contacts the frustoconical surface on the second rotor plate.

The capacity of the compressor is controlled by selective establishment of fluid communication between the control chamber and the suction chamber. In particular, when the second communication path between the control chamber and the suction chamber is opened, the discharge chamber pressure which has accumulated in the control chamber flows into the suction chamber. This essentially removes the rearwardly directed biasing force which acts on the actuator. Consequently, the actuator, which is also under the influence of a resiliently biased coil spring, slides toward the control chamber. The second rotor plate, which is rotatably disposed against the actuator, also slides toward the control chamber. This in turn causes the arm portions of swash plate to slide down their respective frustoconical surfaces in the direction of the drive shaft, thereby decreasing the angle of the swash plate and the capacity of the compressor.

Conversely, when increased compressor capacity is desired, the second communication path is closed and the control chamber slowly fills with discharge chamber pressure which acts on the rear side of actuator. When the force from the discharge chamber pressure overcomes the force of the swash plate, the actuator and the adjacent second rotor plate slide in the direction of the crank chamber. This movement causes the arm portion of swash plate to slide up their respective frustoconical surfaces away from the drive shaft, thereby increasing the angle of the swash plate and the capacity of the compressor.

Further objects, features and advantages of the preferred embodiments will become apparent when the specification is read in conjunction with the drawings.

DETAILED DESCRIPTION OF THE PREFERRED EMBODIMENTS

Figure 3:
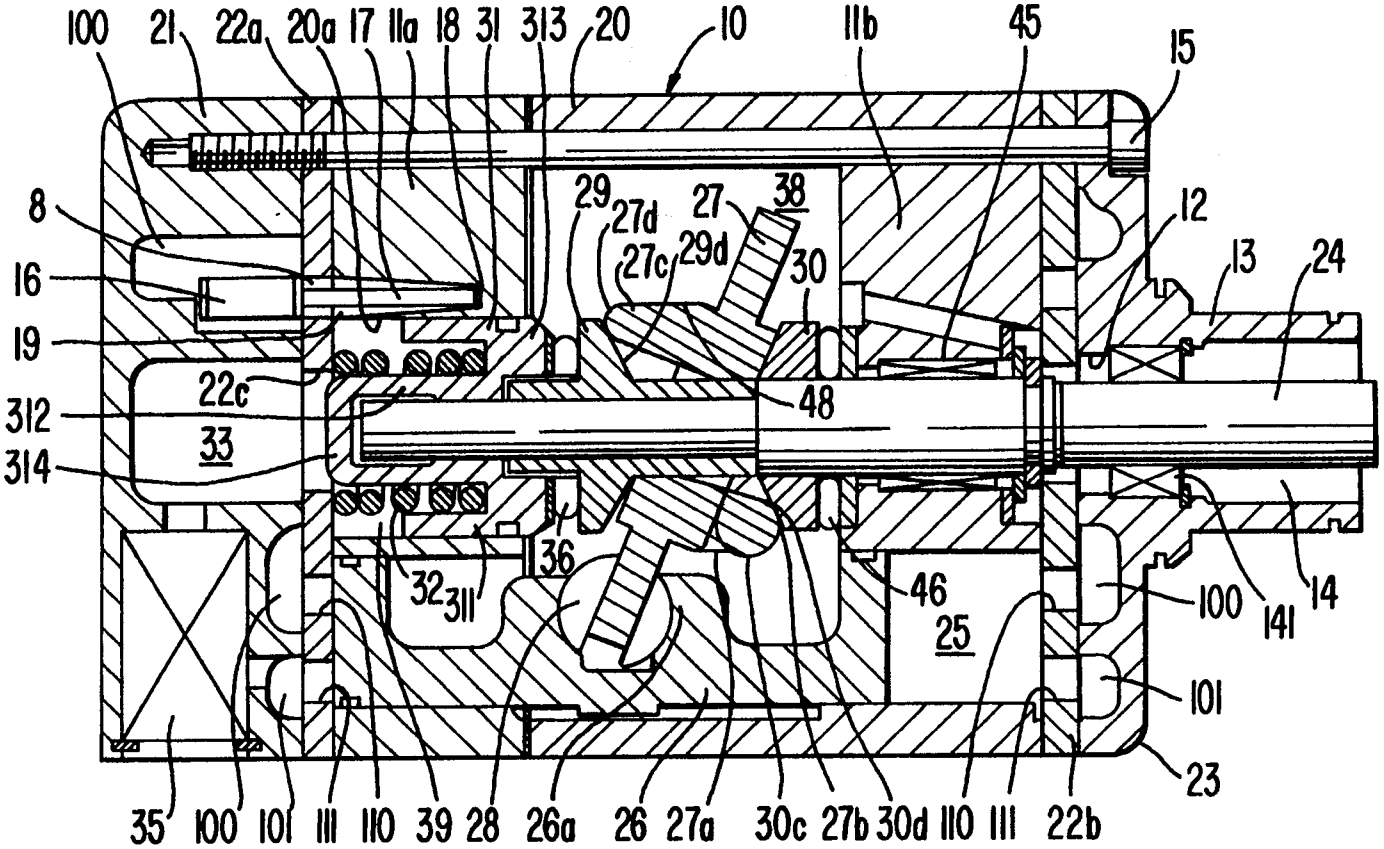
FIG. 3 is a longitudinal sectional view of a swash plate refrigerant compressor with a variable displacement mechanism in accordance with one preferred embodiment.

Referring to FIG. 3, a variable capacity swash plate refrigerant compressor according to the first preferred embodiment is shown. Compressor 10 includes an annular casing 20, left cylinder block 11*a*, right cylinder block 11*b*, crank chamber 38, front end plate 23 and rear end plate 21. A valve plate 22*a* is positioned between rear end plate 21 and left cylinder block 11*a*, and a valve plate 22*b* is positioned between front end plate 23 and left cylinder block 11*b* and annular casing 20.

A plurality of bolts 15 fixedly secure front end plate 23, valve plate 22*b*, right cylinder block 11*b*, left cylinder block 11*a*, valve plate 22*a* and rear end plate 21. An opening 12 is formed in front end plate 23 for receiving drive shaft 24. An annular sleeve 13 projects from the front end surface of front end plate 23 such that a space 14 is formed between the interior surface of annular sleeve 13 and the exterior surface of drive shaft 24. Bearing 141 is positioned in space 14 to rotatably support drive shaft 14 at a first position. In addition, bearing 45, which is disposed in right cylinder block 11*b*, supports drive shaft 24 at a second position. An inner end of drive shaft 24 has a first rotor plate 30 fixedly disposed thereon. A thrust needle bearing 46 is placed between the inner end surface of right cylinder block 11*b* and the adjacent axial end surface of first rotor plate 30. The outer end of drive shaft 24 extending beyond sleeve 13 is driven by the engine of a vehicle through a conventional pulley arrangement.

A second rotor plate 29 is fixedly and slidably secured on drive shaft 24 by, e.g., splines. A swash plate 27 is positioned on drive shaft 24 between first and second rotor plates 30, 29. In addition, swash plate 27 is drivingly coupled with first rotor plate 30 for rotation therewith.

An actuator 31, which forms part of a swash plate tilt control mechanism, is positioned in center bore 20*a* formed in the center of left cylinder block 11*a*. Actuator 31 includes an outer annular portion 311 in sliding contact with the peripheral surface of center bore 20*a*, an inner annular portion 312, a first radial base 313 connecting outer and inner annular portions 311, 312, and a second radial base 314. A radial needle bearing 36 is disposed between the inner end surface of base 313 and the adjacent axial end surface of second rotor plate 29. A coil spring 32 is disposed between the outer end surface of base 313 and valve plate 22*a* to resiliently bias actuator 31 and second rotor plate 29 toward crank chamber 38. An actuating chamber 39 is defined by the inner surface of center bore 20*a* and the outer surface of actuator 31.

Rear end plate 21 includes a suction chamber 101, a discharge chamber 100 and a control chamber 33. Valve plate 22*a* has a plurality of valve suction ports 111 connected between suction chamber 101 and respective cylinders 25, and a plurality of valve discharge ports 110 connected between discharge chamber 100 and respective cylinders 25. In addition, valve plate 22*a* has a hole 22*c* centrally formed therein. Actuating chamber 39 is in fluid communication with control chamber 33 through hole 22*c*.

A bore 20*a* longitudinally extends within cylinder block 11 from a position adjacent to the rear end surface of valve plate 22*a* to a position short of crank chamber 38. Another bore 19 radially extends from bore 20*a* to actuating chamber 39. A capillary tube 17 is disposed in bore 20*a* so that one end is adjacent a terminal end of bore 20*a* and the other end is fixedly secured to valve plate 22*a*. A filter screen 16 is positioned in discharge chamber 100 at the open end of capillary tube 17 adjacent valve plate 22*a*. An O-ring 8 is positioned between capillary tube 17 and valve plate 22*a* to seal the mating surfaces therebetween. Capillary tube 17 bleeds discharge chamber pressure into control chamber 33 through radial passage 19, actuating chamber 39 and hole 22*c* in valve plate 22*a*. During that process, filter screen 16 filters impurities flowing through the air conditioning circuit. A pressure control valve 35 selectively opens and closes a communication path between suction chamber 101 and control chamber 33. Movement of actuator 31 within actuating chamber 39 is controlled by the selective establishment of the communication path between suction chamber 101 and control chamber 33.

Cylinder block 11 includes a plurality of annularly arranged cylinders 25 into which each piston 26 slides. Each piston 26 is double-headed with a piston portion disposed within each cylinder 25 and a connecting portion 26*a* connecting the piston portions. A coupling mechanism in the form of semi-spherical thrust bearing 28 slidably couples swash plate 27 and connecting portion 26*a*. The rotation of drive shaft 24 causes swash plate 27 to rotate between bearings 28. As the inclined surface of swash plate 27 moves axially to the right and left relative to the pistons and their respective cylinder, pistons 26 reciprocate within cylinders 25.

Figure 1:
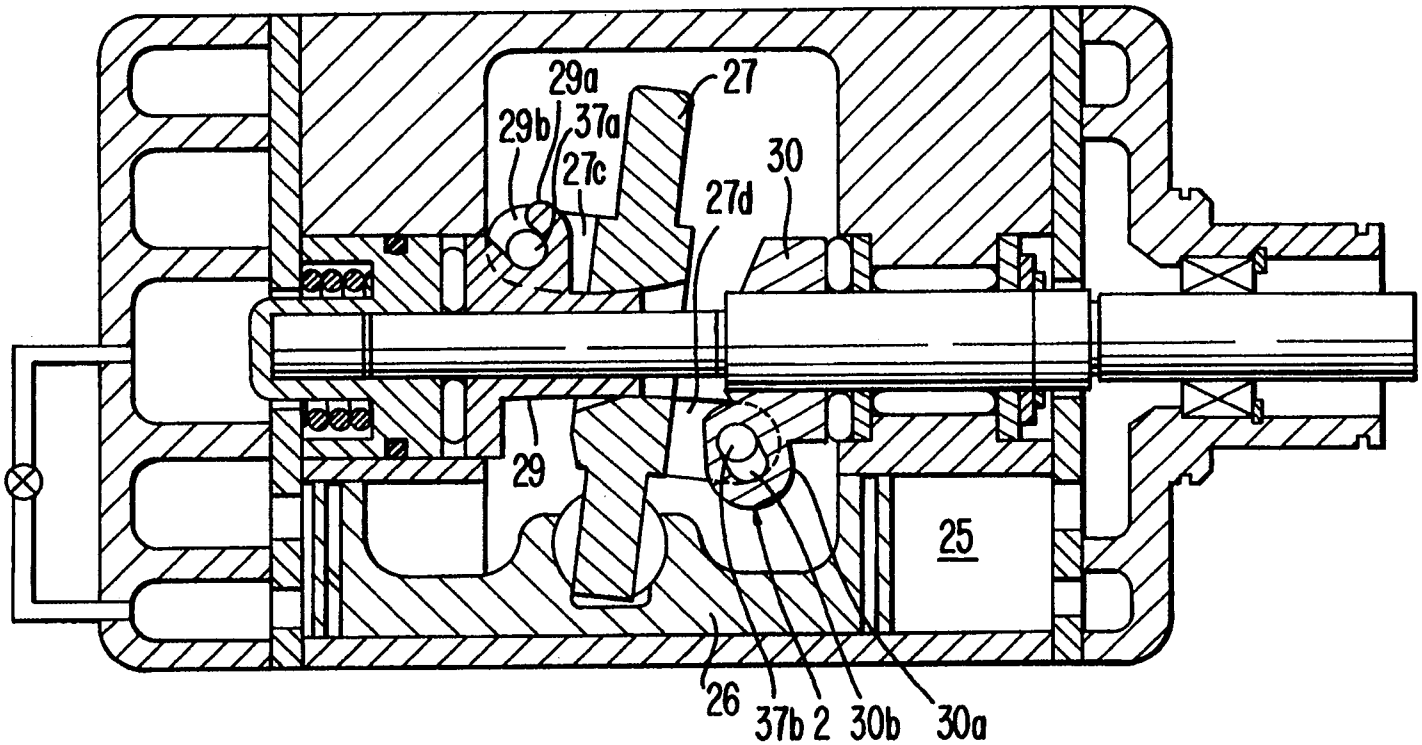
FIG. 1 (PRIOR ART)
FIG. 1 is a longitudinal sectional view of a swash plate refrigerant compressor with a variable displacement mechanism in accordance with the prior art.
Figure 2:
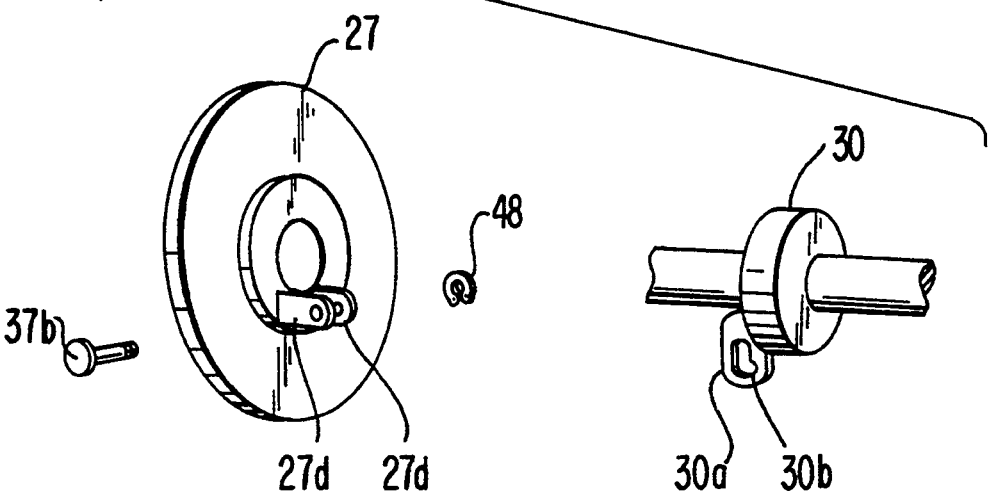
FIG. 2 (PRIOR ART)
FIG. 2 is an illustrative view of a drive mechanism employing a prior art hinge coupling mechanism.
Figure 4:
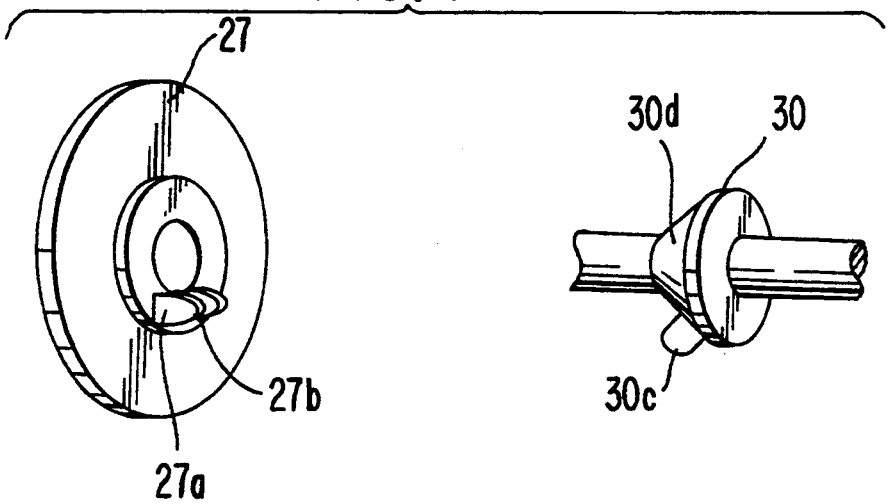
FIG. 4 is an illustrative view of the hinge coupling mechanism of FIG. 3.

As best seen in FIG. 4, first rotor plate 30 has a frustoconical surface 30*d* on which projection 30*c* is fixedly disposed. Swash plate 27 includes a plurality of first arms 27*a*, preferably two arms, projecting toward first rotor plate 30. First arms 27*a* include an end portion 27*b* which, when the compressor is assembled, slidably contact frustoconical surface 30*d* of first rotor plate 30. Further, projection 30*c* is positioned between first arms 27*a*.

Referring again to FIG. 3, second rotor plate 29 also has a frustoconical surface 29*d*. Swash plate 27 includes a second arm 27*c* radially opposed to arms 27*a* on the opposite side of swash plate 27 from arms 27*a*. Second arm 27*c* includes an end portion 27*d* which, when the compressor is assembled, slidably contacts frustoconical surface 29*d* of second rotor plate 29.

In accordance with the above construction, with projection 30*c* disposed between arms 27*a*, axial torque from drive shaft 24 is transmitted through projection 30*c*, to arms 27*a*, and then to swash plate 27. Collectively, arms 27*a* and projection 30*c* define a coupling mechanism for coupling swash plate 27 to drive shaft 24 for rotation therewith. Moreover, swash plate 27 is operatively coupled to first rotor plate 30 and second rotor plate 29 through sliding contact between arms 27*a*, 27*c* and frustoconical surfaces 30*d*, 29*d*, respectively. With this arrangement, swash plate 27 shifts between a position where the tilt angle is large and a position where the tilt angle is small. During the shifting operation, arm 27*c* frictionally slides on surface 29*d* and arms 27*a* frictionally slide on surface 30*d*.

In operation, drive shaft 24 is rotated by the engine of a vehicle through a pulley arrangement. First and second rotor plates 30, 29 rotate with drive shaft 24. The rotary motion of drive shaft 24 is transmitted to swash plate 27 through slide coupling mechanism comprising frustoconical surface 30*d*, projection 30*c* and arm 27*a*. Upon rotation of first and second rotor plates 30, 29, the inclined surface of swash plate 27 moves axially to the right and left relative to cylinders 25. Double-headed pistons 26, which are operatively connected to swash plate through bearing 28, are consequently reciprocated within cylinders 25. As double-headed pistons 26 reciprocate, the refrigerant gas which is introduced into suction chamber 101 from the fluid inlet port is taken into each cylinder 25 and compressed. The compressed refrigerant is discharged to discharge chamber 100 from each cylinder 25 through discharge port 110 and therefrom into an external fluid circuit, for example a cooling circuit, through a fluid outlet port (not shown).

When less capacity is required, pressure control valve 35 is opened to establish a fluid communication path between control chamber 33 and suction chamber 101. Consequently, the high pressure discharge chamber pressure which has been bled into control chamber 33 flows into the lower pressure suction chamber 101. Then, actuator 31 begins to slide leftwardly as seen in FIG. 3. As actuator 31 slides leftwardly, second rotor plate 29 moves in the direction of control chamber 33 and second arm portion 27*d* slides downward along frustoconical surface 29*d* of second rotor plate 29. As a result, the slant angle of swash plate 27 is minimized relative to the vertical plane and pistons 26 stroke with a minimum stroke length.

On the other hand, when it is desirable to increase the refrigerant capacity of the compressor, pressure control valve 35 is activated to close the communication path between control chamber 33 and suction chamber 101. Consequently, high pressure discharge chamber pressure bleeds into control chamber 33. The pressure in control chamber reaches a point at which the force exerted on the back of actuator 31 overcomes the force of arm 27*c* on frustoconical surface 29*d* and the actuator begins to slide rightwardly in FIG. 3. As actuator 31 slides rightwardly, second rotor plate 29 moves in the direction of first rotor plate 30 and second arm portion 27*c* slides upward along frustoconical surface 29*d* of second rotor plate 29. As a result, the slant angle of swash plate 27 is maximized relative to the vertical plane and pistons 26 stroke with a maximum stroke length. Of course, it will be readily appreciated by those skilled in the art that, depending on the operational state of control valve 35, the tilt angle of swash plate 27 can be controlled so that swash plate 27 assumes numerous angles between the minimum and maximum tilt angles.

Figure 5:
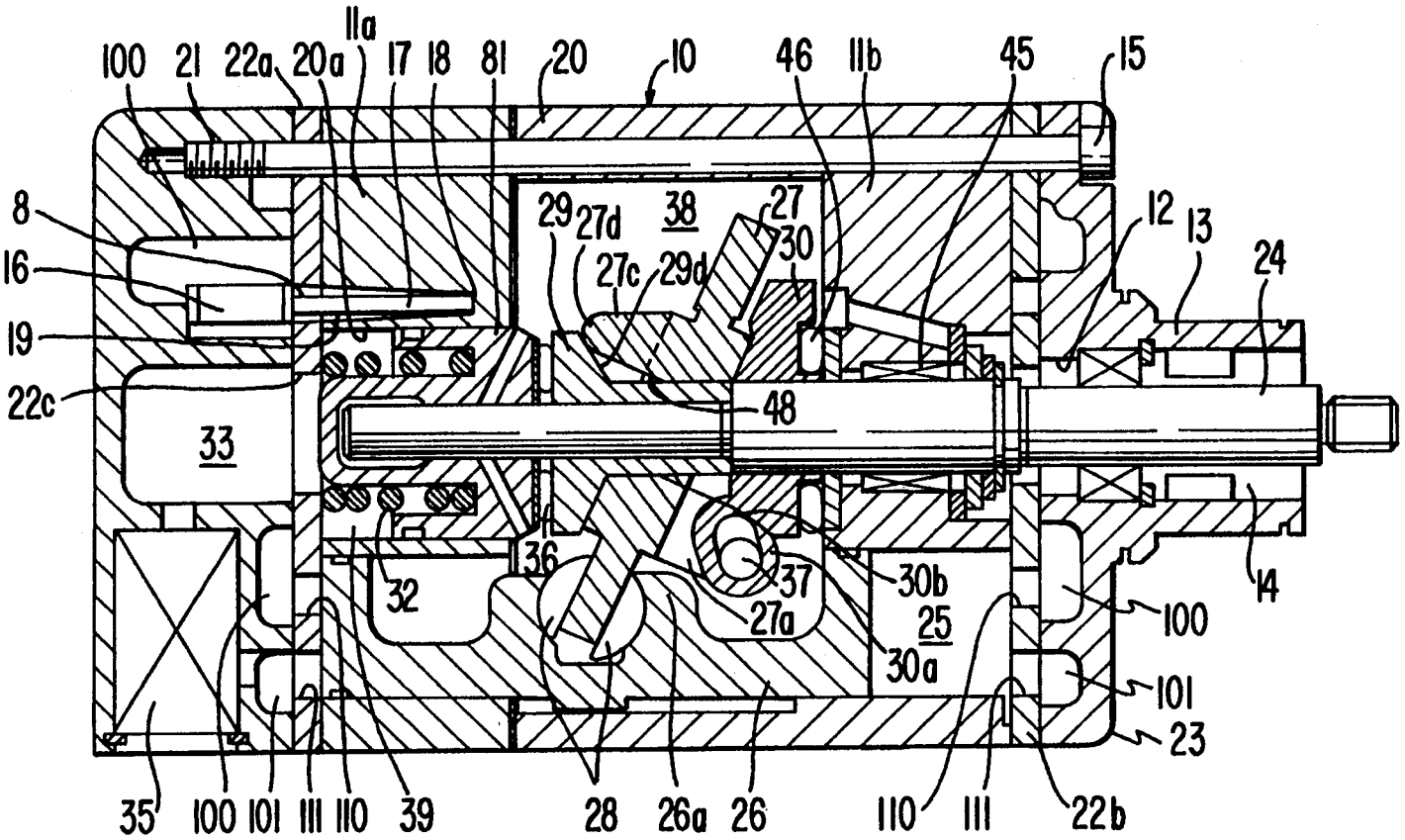
FIG. 5 is a longitudinal sectional view of a swash plate refrigerant compressor with a variable displacement mechanism in accordance with another preferred embodiment.

A second preferred embodiment is depicted in FIG. 5. Elements of the second embodiment which are the same as those in the first embodiment are labelled with the same reference numerals, with the discussion thereof reserved primarily for the features differing between the first and second embodiments.

In the second embodiment, first rotor plate 30 includes projection 30*a* having a slot 30*b* formed therein. A longitudinal axis of slot 30*b* is positioned obliquely with respect to the longitudinal axis of drive shaft 24. Swash plate 27 has a first arm 27*a* extending therefrom. First pin 37 is fixedly attached to first arm 27*a* through, e.g., snap rings. First pin 37 has a first end fixedly secured to first arm 27*a* and a second end extending within slot 30*b*. As with the first preferred embodiment, a pressure control valve 35 is selectively opened and closed to effect capacity control. More particularly, depending on whether pressure control valve is opened or closed, pin 37 slides up or down slot 30*b*. The capacity control operates in substantially the same way as described with respect to the first embodiment.

With either of the two embodiments, the swash plate 27 is operatively coupled with first and second rotors 29, 30 with two hinge coupling mechanisms. Advantageously, these hinge coupling mechanisms are manufactured with only a few parts, so the manufacturing cost of the compressor may be reduced.

Although the invention has been described in connection with the preferred embodiments, it will be understood by those skilled in the art that these embodiments are merely for illustration, and that various further modifications may be made therein without departing from the scope of this invention as defined by the appended claims.

What is claimed is:

1. A swash plate type compressor comprising:

a cylinder block having a plurality of cylinders formed therein;

a piston slidably received in each of said cylinders;

a drive shaft rotatably supported in said cylinder block;

a swash plate coupled to said pistons and said drive shaft;

first coupling means for coupling said swash plate to said pistons so that said pistons may be driven in a reciprocating motion within said cylinders upon rotation of said swash plate;

second coupling means for coupling said swash plate to said drive shaft for rotation therewith, said second coupling means comprising a first arm portion extending from one side of said swash plate and a second arm portion extending from said drive shaft; and tilt control means slidably moving along said drive shaft and slidably contacting a second arm of said swash plate for controlling the tilt angle of said swash plate, said tilt control means comprising a first rotor plate mounted on said drive shaft adjacent said swash plate, said first rotor plate having a frustoconical surface from which said second arm portion extends.

2. The swash plate type compressor of claim 1, said first and second arms are symmetrically arranged on opposite sides of said swash plate.

3. The swash plate type compressor of claim 1, said first and second arm portions operatively coupled so that the tilt angle of said swash plate changes in response to movement of said tilt control means.

4. The swash plate of claim 3, said first and second arm portions are hingedly coupled to each other by a pin and slot mechanism.

5. The swash plate of claim 3, said first and second arm portions interlocked in the rotating direction of said drive shaft.

6. A swash plate type compressor comprising:

a compressor housing including an annular casing and an end plate;

a suction chamber and a discharge chamber formed in said end plate;

a cylinder block having a plurality of cylinders therein;

a valve plate disposed between said cylinder block and said end plate;

a piston slidably disposed in each of said cylinder blocks;

a drive shaft rotatably supported in said cylinder block;

a swash plate disposed on said drive shaft and operatively coupled to said pistons for converting rotating motion of said drive shaft into reciprocating motion of said pistons;

a control chamber formed in said end plate for accumulating working fluid;

an actuator slidably disposed in a first bore in said cylinder block such that a rear end thereof is exposed to the working fluid pressure in said control chamber;

a first communication path formed between said control chamber and said discharge chamber;

a second communication path formed between said control chamber and said suction chamber; and a valve control means disposed in said second communication path for selectively opening and closing said second communication path;

said first communication path comprising a second bore formed in said cylinder block and a radial bore formed in said cylinder block, said second bore having one end opening into said discharge chamber and a second end terminating in said cylinder block and said radial bore having a first end opening into said second bore and a second end opening into said first bore.

7. The compressor of claim 6, further comprising a tilt control mechanism operatively coupled to said swash plate for changing the capacity of the compressor.

8. A swash plate type compressor comprising:

a compressor housing including an annular casing and an end plate;

a suction chamber and a discharge chamber formed in said end plate;

a cylinder block having a plurality of cylinders therein;

a valve plate disposed between said cylinder block and said end plate;

a piston slidably disposed in each of said cylinder blocks;

a drive shaft rotatably supported in said cylinder block;

a swash plate disposed on said drive shaft and operatively coupled to said pistons for converting rotating motion of said drive shaft into reciprocating motion of said pistons;

a control chamber formed in said end plate for accumulating working fluid;

an actuator slidably disposed in a first bore in said cylinder block such that a rear end thereof is exposed to the working fluid pressure in said control chamber;

a first communication path formed between said control chamber and said discharge chamber;

a second communication path formed between said control chamber and said suction chamber;

a valve control means disposed in one of said communication paths for selectively opening and closing one of said communication paths; and a capillary tube disposed in said second bore for introducing discharge pressure into said first communication path, said capillary tube continuously bleeding discharge pressure to said control chamber.

9. A swash plate type compressor comprising:

a compressor housing including an annular casing and an end plate;

a suction chamber and a discharge chamber formed in said end plate;

a cylinder block having a plurality of cylinders therein;

a valve plate disposed between said cylinder block and said end plate;

a piston slidably disposed in each of said cylinder blocks;

a drive shaft rotatably supported in said cylinder block;

a swash plate disposed on said drive shaft and operatively coupled to said pistons for converting rotating motion of said drive shaft into reciprocating motion of said pistons;

a control chamber formed in said end plate for accumulating working fluid;

an actuator slidably disposed in a first bore in said cylinder block such that a rear end thereof is exposed to the working fluid pressure in said control chamber;

a first communication path formed between said control chamber and said discharge chamber;

a second communication path formed between said control chamber and said suction chamber;

a valve control means disposed in one of said communication paths for selectively opening and closing one of said communication paths; and a tilt control mechanism operatively coupled to said swash plate for changing the capacity of the compressor, said tilt control mechanism comprising:

a first rotor plate mounted on said drive shaft; and a second rotor plate slidably mounted on said drive shaft and spaced from said first rotor plate;

said swash plate mounted on said drive shaft between said first and second rotor plates, said second rotor plate having an end surface rotatably disposed against said actuator so that when said actuator slides within said first bore, said swash plate is selectively biased through said second rotor plate between a minimum and maximum swash plate angle.

10. The compressor of claim 9, wherein said valve control means is disposed in said second communication path and said first communication path continuously supplying discharge pressure to said control chamber so that when said valve control means is opened, discharge pressure which has accumulated in said control chamber flows into said suction chamber thereby causing said actuator to slide in a direction to decrease the slant angle of said swash plate.

11. The compressor of claim 10, further comprising a coil spring disposed between said valve plate and said actuator for resiliently biasing said actuator in a direction to increase the angle of said swash plate.

12. A swash plate type compressor comprising:
a compressor housing including an annular casing and an end plate;
a suction chamber and a discharge chamber formed in said end plate;
a cylinder block having a plurality of cylinders therein;
a valve plate disposed between said cylinder block and said end plate;
a piston slidably disposed in each of said cylinder blocks;
a drive shaft rotatably supported in said cylinder block;
a swash plate disposed on said drive shaft and operatively coupled to said pistons for converting rotating motion of said drive shaft into reciprocating motion of said pistons;
a control chamber formed in said end plate for accumulating working fluid;
an actuator slidably disposed in a first bore in said cylinder block such that a rear end thereof is exposed to the working fluid pressure in said control chamber;
a first communication path formed between said control chamber and said discharge chamber;
a second communication path formed between said control chamber and said suction chamber;
a valve control means disposed in one of said communication paths for selectively opening and closing one of said communication paths; and
a tilt control mechanism for controlling the slant angle of said swash plate, said tilt control mechanism comprising:
a first rotor disposed on said drive shaft; and
a second rotor disposed on said drive shaft and spaced from said first rotor;
said swash plate disposed between said first and second rotors and operatively coupled to at least one of said first and second rotors for rotation therewith.

13. The compressor of claim 12, said first rotor having a frustoconical surface facing said swash plate and a projection extending from said frustoconical surface and said swash plate having a first arm extending toward said first rotor, said projection operatively coupled to said first arm for transmitting rotating motion of said drive shaft to said swash plate.

14. The compressor of claim 13, said second rotor having a frustoconical surface facing said swash plate and said swash plate having a second arm extending toward said second rotor plate, said second arm cooperating with said frustoconical surface on said second rotor plate so that during capacity control, said second arm slides on said frustoconical surface on said second rotor plate.

15. The compressor of claim 12, said second rotor having a frustoconical surface facing said swash plate and said swash plate having a second arm extending toward said second rotor plate, said second arm cooperating with said frustoconical surface on said second rotor plate so that during capacity control, said second arm slides on said frustoconical surface on said second rotor plate.

16. A swash plate type compressor comprising:
a compressor housing including an annular casing and an end plate;
a cylinder block operatively coupled to said annular casing and said end plate and having a plurality of cylinders formed therein;
a plurality of pistons slidably disposed in said cylinders;
a crank chamber formed on one side of said cylinder block opposite said end plate;
a valve plate disposed between said end plate and said cylinder block;
a suction chamber and a discharge chamber formed in said end plate;
a drive shaft rotatably mounted on said cylinder block;
a swash plate mounted on said drive shaft in said crank chamber and operatively coupled to said pistons, said swash plate converting rotating motion of said drive shaft into reciprocating motion of said pistons; and
a tilt control means for changing the angle of said swash plate, said tilt control means comprising:
a first rotor plate mounted on said drive shaft adjacent said swash plate, said first rotor having a frustoconical surface and a projection extending therefrom; and
a second rotor plate slidably mounted on said drive shaft on an opposite side of said swash plate from said first rotor, said second rotor including a frustoconical surface;
said swash plate including a first arm extending toward said first rotor and a second arm extending toward said second rotor, said first and second arms disposed in sliding contact with said respective frustoconical surfaces.

17. The compressor of claim 16, further comprising an actuator slidably disposed in a bore in said cylinder block, said actuator operatively coupled to a rear surface of said second rotor plate so that when said actuator slides in said bore, the angle of said swash plate is variably controlled.

18. The compressor of claim 17, further comprising:
a control chamber formed in said end plate, said actuator separating said control chamber from said crank chamber;
a first communication path formed between said discharge chamber and said control chamber;
a second communication path formed between said control chamber and said suction chamber;
means for continuously bleeding discharge chamber pressure into said control chamber to bias said swash plate through said actuator between a maximum and minimum swash plate angle; and
a valve control means positioned in said second communication path for selectively opening and closing said second communication path to allow fluid in said control chamber to flow into said suction chamber.

* * * * *